US009347462B2

(12) United States Patent
Fizer et al.

(10) Patent No.: US 9,347,462 B2
(45) **Date of Patent: *May 24, 2016**

(54) FAN BLADE RETENTION SYSTEM

(71) Applicant: DELTA T CORPORATION, Lexington, KY (US)

(72) Inventors: Richard W. Fizer, Lexington, KY (US); C. Jason Hollan, Lexington, KY (US); Jason H. Fizer, Lexington, KY (US); Mark A. Toy, Lexington, KY (US); Richard A. Oleson, Lexington, KY (US)

(73) Assignee: DELTA T CORPORATION, Lexington, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/324,554

(22) Filed: Jul. 7, 2014

(65) Prior Publication Data

US 2015/0078902 A1 Mar. 19, 2015

Related U.S. Application Data

(63) Continuation of application No. 13/087,436, filed on Apr. 15, 2011, now Pat. No. 8,770,937.

(60) Provisional application No. 61/369,953, filed on Aug. 2, 2010, provisional application No. 61/326,855, filed on Apr. 22, 2010.

(51) Int. Cl.

| | |
|---|---|
| ***F04D 29/34*** | (2006.01) |
| ***F04D 25/08*** | (2006.01) |
| ***F04D 29/32*** | (2006.01) |

(52) U.S. Cl.

CPC ..... *F04D 29/34* (2013.01); *F04D 25/088* (2013.01); *F04D 29/329* (2013.01)

(58) Field of Classification Search

CPC ..... F04D 29/32; F04D 29/329; F04D 25/088; F04D 29/34

USPC ..... 416/210 R, 2, 225

See application file for complete search history.

(56) References Cited

U.S. PATENT DOCUMENTS

| | | | | |
|---|---|---|---|---|
| 5,542,819 | A * | 8/1996 | Bucher et al. | 416/146 R |
| 2009/0208333 | A1 * | 8/2009 | Smith et al. | 416/5 |

FOREIGN PATENT DOCUMENTS

| | | | |
|---|---|---|---|
| CN | 201496319 U | * | 6/2010 |
| JP | 59155576 A | * | 9/1984 |

OTHER PUBLICATIONS

CN 201496319 U Machine Translation. Accessed EPO Oct. 25, 2013.*

*Primary Examiner* — Richard Edgar

(74) *Attorney, Agent, or Firm* — King & Schickli, PLLC

(57) ABSTRACT

A fan comprises a rotatable hub assembly having an inner anchor assembly, a plurality of fan blades, a motor assembly, and a plurality of cables. The outer ends of the cables are coupled to the outer ends of the fan blades, and the inner ends of the cables are coupled to the inner anchor assembly. The inner anchor assembly may further include a disc-shaped plate and a plurality of inner anchor members to which the cables may be coupled. The inner anchor members may include a rear anchor portion and fore anchor portion, and these anchor portions may be angularly offset. A plurality of winglets and/or outer anchor members may be coupled to the outer ends of the fan blades to which the outer ends of the cables may be coupled. The outer ends of the cables may further comprise swaged tips outboard of the winglets and/or outer anchor members.

13 Claims, 10 Drawing Sheets

FAN BLADE RETENTION SYSTEM

PRIORITY

This application claims priority to U.S. Provisional Application Ser. No. 61/326,855, entitled "Fan Blade Retention System," filed Apr. 22, 2010, the disclosure of which is incorporated by reference herein; and U.S. Provisional Application Ser. No. 61/369,953, entitled "Fan Blade Retention System," filed Aug. 2, 2010, the disclosure of which is incorporated by reference herein.

BACKGROUND

A variety of fan systems have been made and used over the years in a variety of contexts. For instance, various ceiling fans are disclosed in U.S. Pat. No. 7,284,960, entitled "Fan Blades," issued Oct. 23, 2007; U.S. Pat. No. 6,244,821, entitled "Low Speed Cooling Fan," issued Jun. 12, 2001; U.S. Pat. No. 6,939,108, entitled "Cooling Fan with Reinforced Blade," issued Sep. 6, 2005; and U.S. Pat. No. D607,988, entitled "Ceiling Fan," issued Jan. 12, 2010. The disclosures of each of those U.S. patents are incorporated by reference herein. Additional exemplary fans are disclosed in U.S. Pat. Pub. No. 2008/0008596, entitled "Fan Blades," published Jan. 10, 2008; U.S. Pat. Pub. No. 2009/0208333, entitled "Ceiling Fan System with Brushless Motor," published Aug. 20, 2009; and U.S. Pat. Pub. No. 2010/0278637, entitled "Ceiling Fan with Variable Blade Pitch and Variable Speed Control," published Nov. 4, 2010, the disclosures of which are also incorporated by reference herein. It should be understood that teachings herein may be incorporated into any of the fans described in any of the above-referenced patents, publications, or patent applications.

A fan blade or airfoil may include one or more upper air fences and/or one or more lower air fences at any suitable position(s) along the length of the fan blade or airfoil. Merely exemplary air fences are described in U.S. Pat. App. No. 12/889,475, entitled "Air Fence for Fan Blade," filed Sep. 24, 2010, the disclosure of which is incorporated by reference herein. Alternatively, any other suitable type of component or feature may be positioned along the length of a fan blade or airfoil; or such components or features may simply be omitted.

The outer tip of a fan blade or airfoil may be finished by the addition of an aerodynamic tip or winglet. Merely exemplary winglets are described in U.S. Pat. No. 7,252,478, entitled "Fan Blade Modifications," issued Aug. 7, 2007, the disclosure of which is incorporated by reference herein. Additional winglets are described in U.S. Pat. Pub. No. 2008/0014090, entitled "Cuffed Fan Blade Modifications," published Jan. 17, 2008, filed Sep. 25, 2007, the disclosure of which is incorporated by reference herein. Still other exemplary winglets are described in U.S. Pat. No. D587,799, entitled "Winglet for a Fan Blade," issued Mar. 3, 2009, the disclosure of which is incorporated by reference herein. In some settings, such winglets may interrupt the outward flow of air at the tip of a fan blade, redirecting the flow to cause the air to pass over the fan blade in a perpendicular direction, and also ensuring that the entire air stream exits over the trailing edge of the fan blade and reducing tip vortex formation. In some settings, this may result in increased efficiency in operation in the region of the tip of the fan blade. In other variations, an angled extension may be added to a fan blade or airfoil, such as the angled airfoil extensions described in U.S. Pat. Pub. No. 2008/0213097, entitled "Angled Airfoil Extension for Fan Blade," published Sep. 4, 2008, the disclosure of which is incorporated by reference herein. Other suitable structures that may be associated with an outer tip of an airfoil or fan blade will be apparent to those of ordinary skill in the art. Alternatively, the outer tip of an airfoil or fan blade may be simply closed (e.g., with a cap or otherwise, etc.), or may lack any similar structure at all.

The interface of a fan blade and a fan hub may also be provided in a variety of ways. For instance, an interface component is described in U.S. Pat. Pub. No. 2009/0081045, entitled "Aerodynamic Interface Component for Fan Blade," published Mar. 26, 2009, the disclosure of which is incorporated by reference herein. Alternatively, the interface of a fan blade and a fan hub may include any other component or components, or may lack any similar structure at all.

Fans may also include a variety of mounting structures. For instance, a fan mounting structure is disclosed in U.S. Pat. Pub. No. 2009/0072108, entitled "Ceiling Fan with Angled Mounting," published Mar. 19, 2009, the disclosure of which is incorporated herein. Of course, a fan need not be mounted to a ceiling or other overhead structure, and instead may be mounted to a wall or to the ground. For instance, a fan may be supported on the top of a post that extends upwardly from the ground. Alternatively, any other suitable mounting structures and/or mounting techniques may be used in conjunction with embodiments described herein.

It should also be understood that a fan may include sensors or other features that are used to control, at least in part, operation of a fan system. For instance, such fan systems are disclosed in U.S. Pat. Pub. No. 2009/0097975, entitled "Ceiling Fan with Concentric Stationary Tube and Power-Down Features," published Apr. 16, 2009, the disclosure of which is incorporated by reference herein; U.S. Pat. Pub. No. 2009/0162197, entitled "Automatic Control System and Method to Minimize Oscillation in Ceiling Fans," published Jun. 25, 2009, the disclosure of which is incorporated by reference herein; U.S. Pat. Pub. No. 2010/0291858, entitled "Automatic Control System for Ceiling Fan Based on Temperature Differentials," published Nov. 18, 2010, the disclosure of which is incorporated by reference herein; and U.S. Provisional Patent App. No. 61/165,582, entitled "Fan with Impact Avoidance System Using Infrared," filed Apr. 1, 2009, the disclosure of which is incorporated by reference herein. Alternatively, any other suitable control systems/features may be used in conjunction with embodiments described herein.

While a variety of fans and fan systems have been made and used, it is believed that no one prior to the inventors has made or used a fan system as described herein.

BRIEF DESCRIPTION OF THE DRAWINGS

While the specification concludes with claims which particularly point out and distinctly claim the invention, it is believed the present invention will be better understood from the following description of certain examples taken in conjunction with the accompanying drawings, in which like reference numerals identify the same elements and in which:

Figure 1:
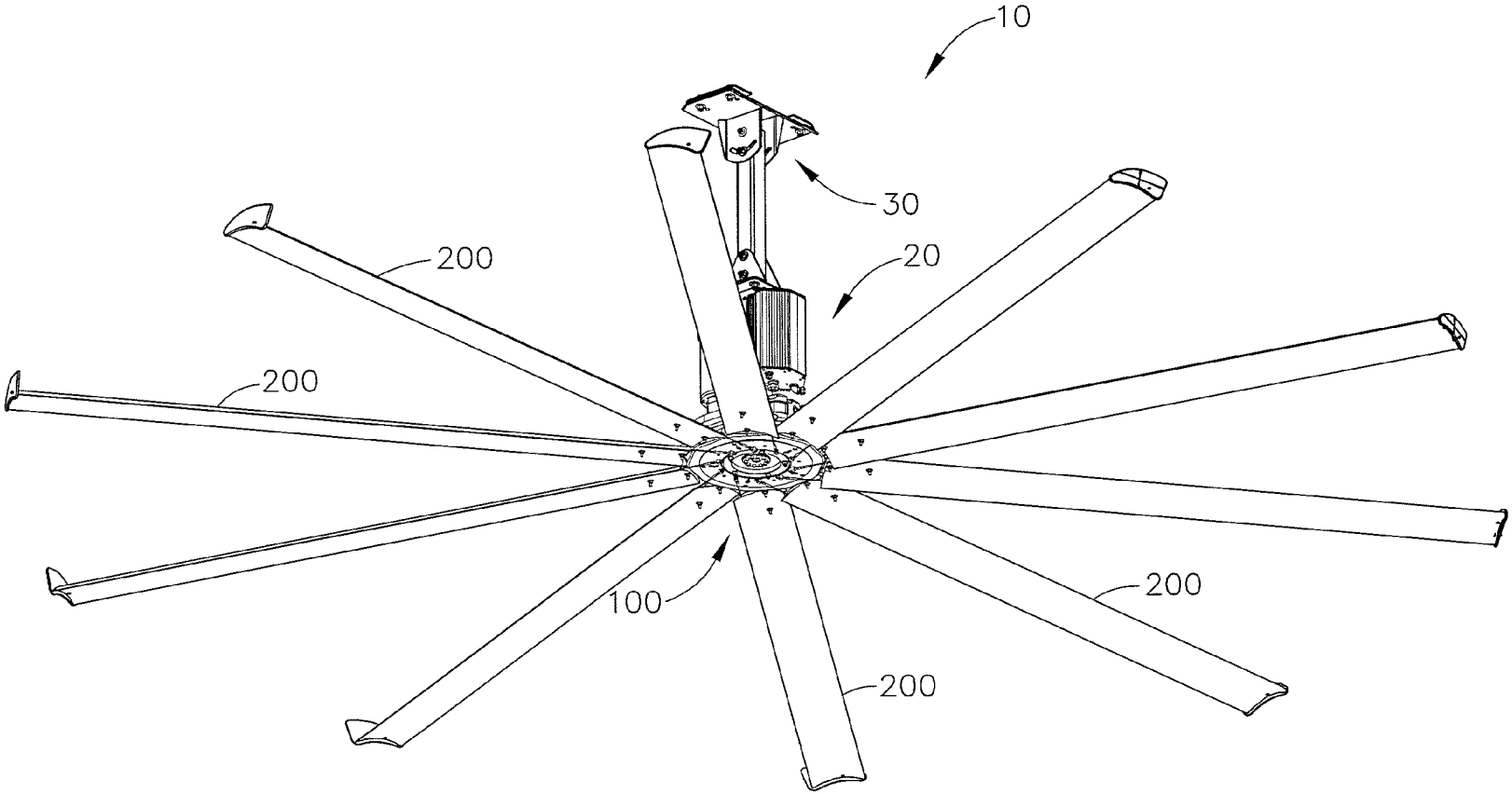
FIG. 1 depicts a perspective view of an exemplary fan having a motor assembly, a hub assembly, a support, and a plurality of fan blades.

The drawings are not intended to be limiting in any way, and it is contemplated that various embodiments of the invention may be carried out in a variety of other ways, including those not necessarily depicted in the drawings. The accompanying drawings incorporated in and forming a part of the specification illustrate several aspects of the present invention, and together with the description serve to explain the principles of the invention; it being understood, however, that this invention is not limited to the precise arrangements shown.

DETAILED DESCRIPTION

The following description of certain examples of the invention should not be used to limit the scope of the present invention. Other examples, features, aspects, embodiments, and advantages of the invention will become apparent to those skilled in the art from the following description, which includes by way of illustration, one or more of the best modes contemplated for carrying out the invention. As will be realized, the invention is capable of other different and obvious aspects, all without departing from the invention. Accordingly, the drawings and descriptions should be regarded as illustrative in nature and not restrictive.

I. Exemplary Fan Overview

Referring to FIG. 1, a fan (10) of the present example comprises a motor assembly (20), a support (30), a hub assembly (100), and a plurality of fan blades (200). In the present example, fan (10) (including hub assembly (100) and fan blades (200)) has a diameter of approximately 8 feet. In other variations, fan (10) has a diameter between approximately 6 feet, inclusive, and approximately 24 feet, inclusive. Alternatively, fan (10) may have any other suitable dimensions.

Support (30) is configured to be coupled to a surface or other structure at a first end such that fan (10) is substantially attached to the surface or other structure. Support (30) of the present example comprises an elongate metal tube-like structure that couples fan (10) to a ceiling, though it should be understood that support (30) may be constructed and/or configured in a variety of other suitable ways as will be apparent to one of ordinary skill in the art in view of the teachings herein. By way of example only, support (30) need not be coupled to a ceiling or other overhead structure, and instead may be coupled to a wall or to the ground. For instance, support (30) may be positioned on the top of a post that extends upwardly from the ground. Alternatively, support (30) may be mounted in any other suitable fashion at any other suitable location. This includes, but is not limited to, the teachings of the patents, patent publications, or patent applications cited herein. By way of example only, support (30) may be configured in accordance with the teachings of U.S. Pat. Pub. No. 2009/0072108, entitled "Ceiling Fan with Angled Mounting," published Mar. 19, 2009, the disclosure of which is incorporated by reference herein. As yet another alternative, support (30) may have any other suitable configuration.

Motor assembly (20) of the present example comprises an AC induction motor having a drive shaft, though it should be understood that motor assembly (20) may alternatively comprise any other suitable type of motor (e.g., a permanent magnet brushless DC motor, a brushed motor, an inside-out motor, etc.). In the present example, motor assembly (20) is fixedly coupled to support (30) and rotatably coupled to hub assembly (100). Furthermore, motor assembly (20) is operable to rotate hub assembly (100) and the plurality of fan blades (200). By way of example only, motor assembly (20) may be constructed in accordance with at least some of the teachings of U.S. Pat. Pub. No. 2009/0208333, entitled "Ceiling Fan System with Brushless Motor," published Aug. 20, 2009, the disclosure of which is incorporated by reference herein. Furthermore, fan (10) may include control electronics that are configured in accordance with at least some of the teachings of U.S. Pat. Pub. No. 2010/0278637, entitled "Ceiling Fan with Variable Blade Pitch and Variable Speed Control," published Nov. 4, 2010, the disclosure of which is incorporated by reference herein. Alternatively, motor assembly (20) may have any other suitable components, configurations, functionalities, and operability, as will be apparent to those of ordinary skill in the art in view of the teachings herein.

Figure 4:
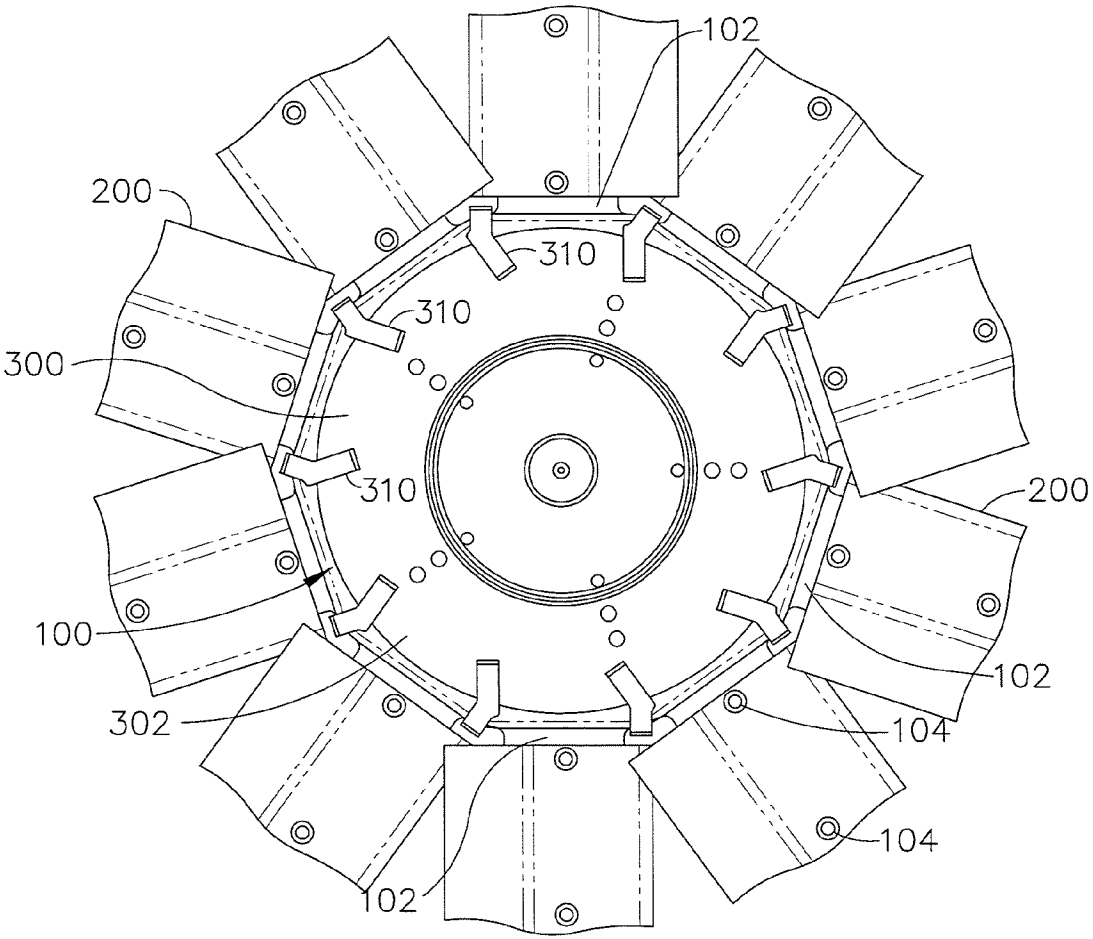
FIG. 4 depicts a partial bottom plan view of the hub assembly of the fan of FIG. 1, showing an inner anchor assembly.

Referring to FIG. 4, hub assembly (100) of the present example comprises a plurality of radially outwardly extending tabs (102). Tabs (102) may be provided in accordance with at least some of the teachings of U.S. Pat. Pub. No. 2010/0278637, entitled "Ceiling Fan with Variable Blade Pitch and Variable Speed Control," published Nov. 4, 2010, the disclosure of which is incorporated by reference herein. Each tab (102) further comprises a plurality of mounting holes such that fan blades (200) are fixedly coupled to each corresponding tab (102) and such that fan blades (200) rotate unitarily with hub assembly (100). In the present example, fan blades (200) are shown mounted to tabs (102) by two mounting members (104), such as bolts or screws, though it should be understood that alternative mounting methods may be employed. For example, fan blades (200) may be mounted by adhesives, by friction fit, and/or by any combination of suitable mountings as will be apparent to one of ordinary skill in the art in light of the teachings herein. It should also be understood that an interface component (not shown) may be provided at the interface of each fan blade (200) and hub assembly (100). By way of example only, such an interface component may be configured in accordance with the teachings of U.S. Pat. Pub. No. 2009/0081045, entitled "Aerodynamic Interface Component for Fan Blade," published Mar. 26, 2009, the disclosure of which is incorporated by reference herein. Hub assembly (100) is further secured to the drive shaft of motor assembly (20) (as shown in FIG. 1) such that hub assembly (100) and the drive shaft rotate unitarily.

II. Exemplary Fan Blades and Modifications

Figures 2, 3:
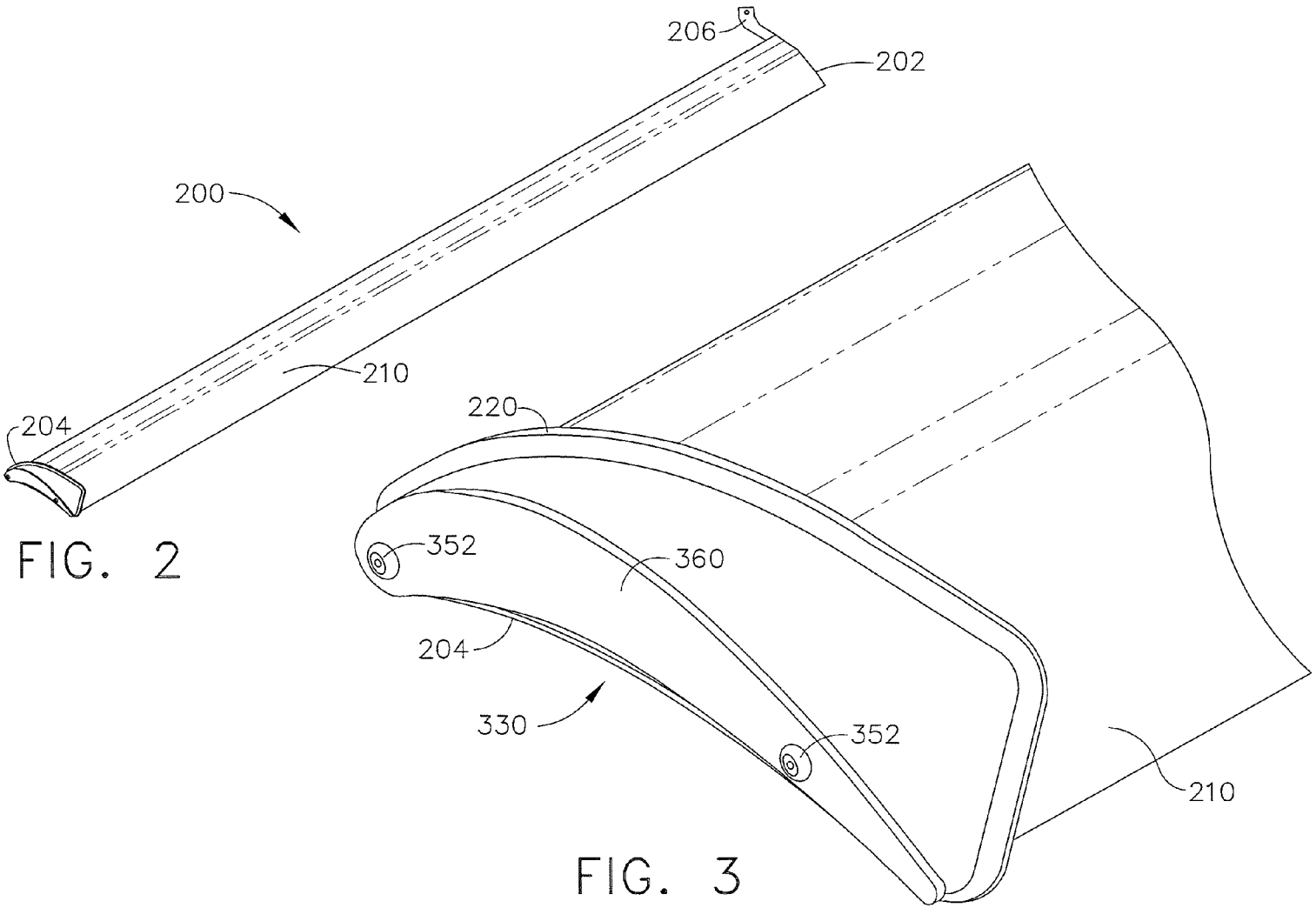
FIG. 2 depicts a top perspective view of a fan blade of the fan of FIG. 1.
FIG. 3 depicts a partial top perspective view of the free end of the fan blade of FIG. 2.

As shown in FIGS. 2-3, an exemplary fan blade (200) comprises a first end (202) and a second end (204). Each fan blade (200) is coupled to hub assembly (100) (as seen in FIG. 1) at first end (202), and each fan blade (200) extends radially outwardly from hub assembly (100), as will be described in more detail below. Fan blades (200) further define at least one channel (210) extending through fan blade (200) from first end (202) to second end (204) such that a cable, such as cable (350) of FIGS. 7-8 as will be described below, may extend through the at least one channel (210) from first end (202) to second end (204). In the present example, each fan blade (200) is substantially hollow forming a single channel (210), though it should be understood that this is merely optional. Alternatively, each fan blade (200) may define multiple channels (210) permitting any number of cables to extend therethrough. In yet another alternative, each fan blade (200) may have a U-shaped channel formed in the bottom surface of each fan blade (200) such that each cable (350) does not extend through the fan blade (200); but rather, each cable (350) extends along the exterior of each fan blade (200) within the U-shaped channel.

Fan blades (200) may further be constructed in accordance with some or all of the teachings of any of the patents, patent publications, or patent applications cited herein. For example, fan blades (200) may be configured in accordance with the teachings of U.S. Pat. No. 7,284,960, entitled "Fan Blades," issued Oct. 23, 2007; U.S. Pat. No. 6,244,821, entitled "Low Speed Cooling Fan," issued Jun. 12, 2001; and/or U.S. Pat. No. 6,939,108, entitled "Cooling Fan with Reinforced Blade," issued Sep. 6, 2005. The disclosures of each of those U.S. patents are incorporated by reference herein. As another merely illustrative example, fan blades (200) may be configured in accordance with the teachings of U.S. Pat. Pub. No. 2008/0008596, entitled "Fan Blades," published Jan. 10, 2008, the disclosure of which is also incorporated by reference herein. As yet another merely illustrative example, fan blades (200) may be configured in accordance with the teachings of U.S. Pat. Pub. No. 2010/0104461, entitled "Multi-Part Modular Airfoil Section and Method of Attachment Between Parts," published Apr. 29, 2010, the disclosure of which is incorporated by reference herein. Alternatively, any other suitable configurations for fan blades (200) may be used in conjunction with the examples described herein. In the present example, fan blades (200) are formed of aluminum through an extrusion process such that each fan blade has a substantially uniform cross section along its length. It should be understood that fan blades (200) may alternatively be formed using any suitable material, or combination of materials, by using any suitable technique, or combination of techniques, and may have any suitable cross-sectional properties or other properties as will be apparent to one of ordinary skill in the art in view of the teachings herein.

Fan blades (200) of the present example may further include a variety of modifications. By way of example only, fan blade (200) of the present example further comprises a winglet (220) coupled to the second end (204) of fan blade (200). Winglets (220) may be constructed in accordance with some or all of the teachings of any of the patents, patent publications, or patent applications cited herein. For instance, winglets (220) may be configured in accordance with at least some of the teachings of U.S. Pat. No. 7,252,478, entitled "Fan Blade Modifications," issued Aug. 7, 2007, the disclosure of which is incorporated by reference herein. As another merely illustrative example, winglets (220) may be configured in accordance with the teachings of U.S. Pat. Pub. No. 2008/0014090, entitled "Cuffed Fan Blade Modifications," published Jan. 17, 2008, the disclosure of which is incorporated by reference herein. As yet another merely illustrative example, winglets (220) may be configured in accordance with the teachings of U.S. Pat. No. D587,799, entitled "Winglet for a Fan Blade," issued Mar. 3, 2009, the disclosure of which is incorporated by reference herein. Of course, any other suitable configuration for winglets (220) may be used as will be apparent to those of ordinary skill in the art in light of the teachings herein.

It should also be understood that winglet (220) is merely optional. For instance, other alternative modifications for fan blades (200) may include end caps, angled airfoil extensions, integrally formed closed ends, or substantially open ends. By way of example only, an angled extension may be added to the free end of each fan blade (200) in accordance with the teachings of U.S. Pat. Pub. No. 2008/0213097, entitled "Angled Airfoil Extension for Fan Blade," published Sep. 4, 2008, the disclosure of which is incorporated by reference herein. Other suitable structures that may be associated with second end (204) of each fan blade (200) will be apparent to those of ordinary skill in the art in view of the teachings herein.

III. Exemplary Fan Blade Retention Features

As noted above, the fan (10) of the present example comprises hub assembly (100) and a plurality of fan blades (200) that are mechanically attached to hub assembly (100); hub assembly (100), in turn, being secured to motor assembly (20). In some instances, redundant systems are used to provide for the retention of hub assembly (100) and fan blades (200) in the event of a structural failure for part of fan (10). For instance, to prevent the inadvertent separation of hub assembly (100) from motor assembly (20), one or more attachments may be provided by means of which hub assembly (100) will engage an additional part of motor assembly (20) and/or support (30). Thus, in the event of a separation of the drive shaft from hub assembly (100)—the primary attachment between hub assembly (100) and motor assembly (20)—the one or more safety attachments prevent the hub assembly (100) from completely disconnecting relative to motor assembly (20) and/or support (30). Some examples of such safety attachments are disclosed in the various references that are cited herein. In addition or in the alternative, to prevent inadvertent separation of the plurality of fan blades (200) from hub assembly (100), a plurality of fan blade attachments (206) (as shown in FIG. 2) may be provided that interconnect among fan blades (200) such that the plurality of fan blades (200) provide mutual support and attachment in the event of the separation of a single fan blade (200) from the corresponding tab (102) on hub assembly (100). Again, some examples of such attachments are disclosed in the various references that are cited herein.

In the present example, an additional redundant system is provided for the retention of fan blades (200) onto hub assembly (100) in the event of a failure of both the attachment by tab (102) and the redundant secondary attachment system of fan blade attachments (206) (e.g., due to misuse of fan (10) by an operator of fan (10)). Referring to FIGS. 3-9, such an additional redundant system includes an inner anchor assembly (300) (as shown in FIG. 4) comprising a disc-shaped plate (302) that is securely attached to hub assembly (100) and is coaxial and parallel to hub assembly (100). A plurality of outer anchors (330) (as shown in FIG. 3) are positioned at respective second ends (204) of fan blades (200) or to winglets (220); and a plurality of cables (350) (as shown in FIGS. 7-8) are coupled at a first end to inner anchor assembly (300) and coupled at a second end to outer anchors (330). While cables (350) of the present example comprise steel cables, it should be understood that any other suitable material or combination of materials may be used to form cables (350). Of course, any other suitable number of outer anchors (330) and/or cables (350) may be used, and such outer anchors (330) may be secured at any suitable location on fan blades (200).

Figure 6:
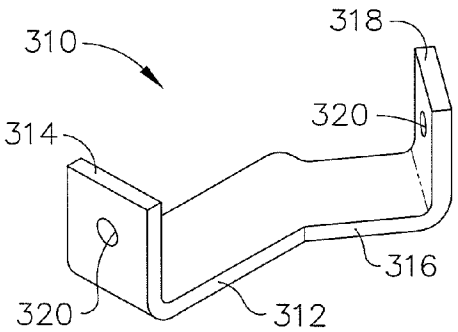
FIG. 6 depicts a perspective view of one of the inner anchor members of FIG. 5.
Figure 5:
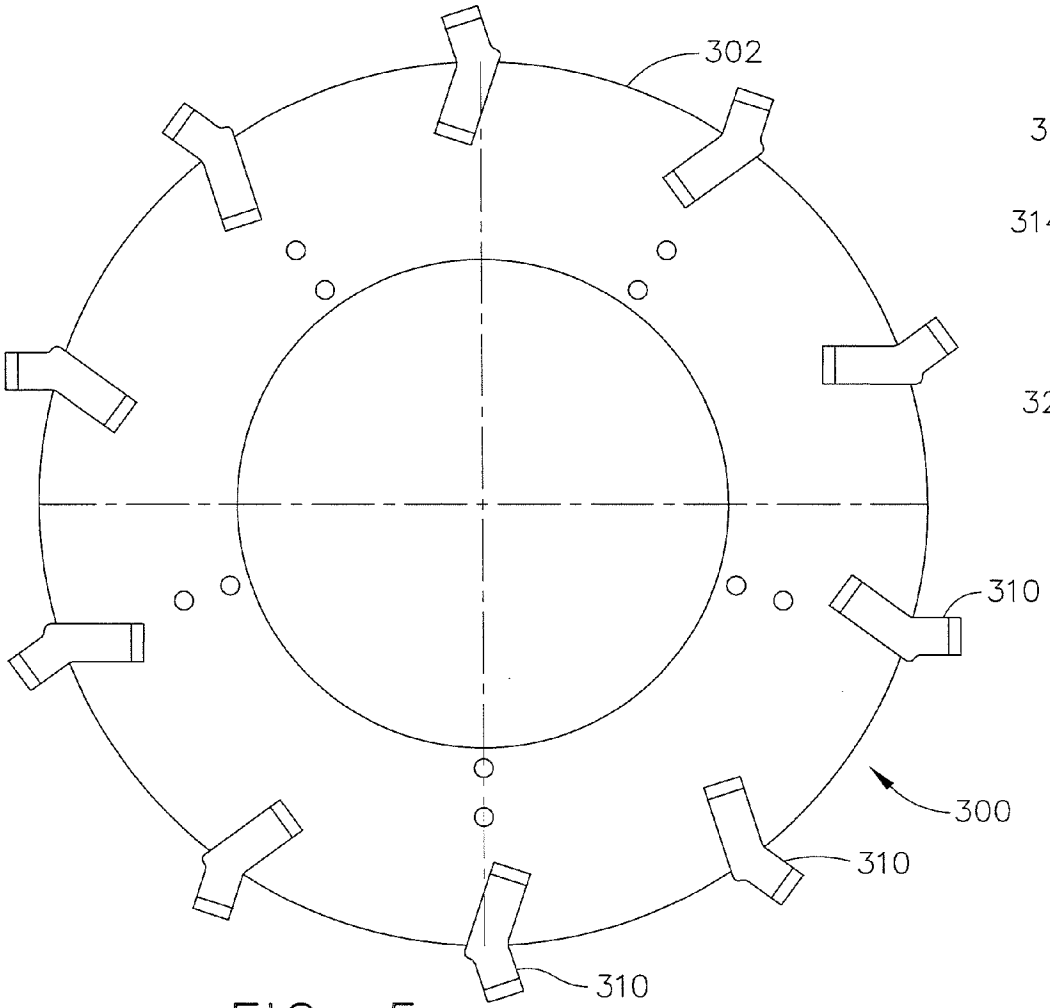
FIG. 5 depicts a bottom plan view of the inner anchor assembly of FIG. 4, showing a plurality of inner anchor members.
Figure 7:
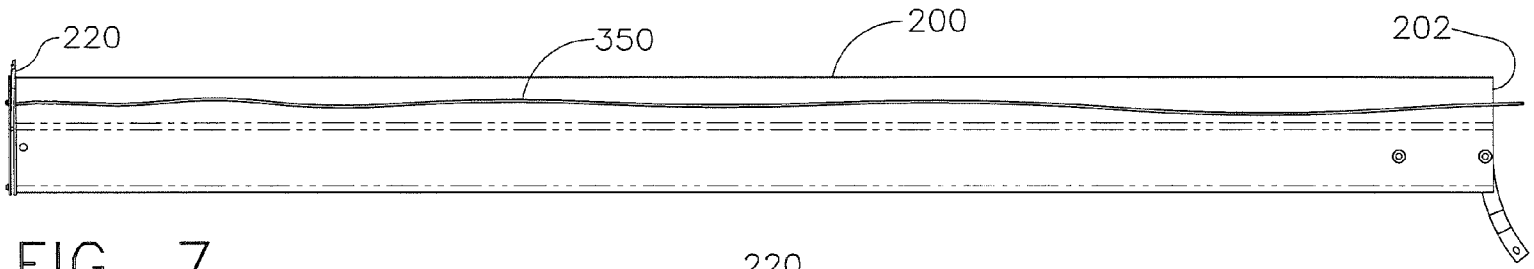
FIG. 7 depicts a top cross-sectional view of the fan blade of FIG. 2, showing an exemplary cable therein.
Figure 8:
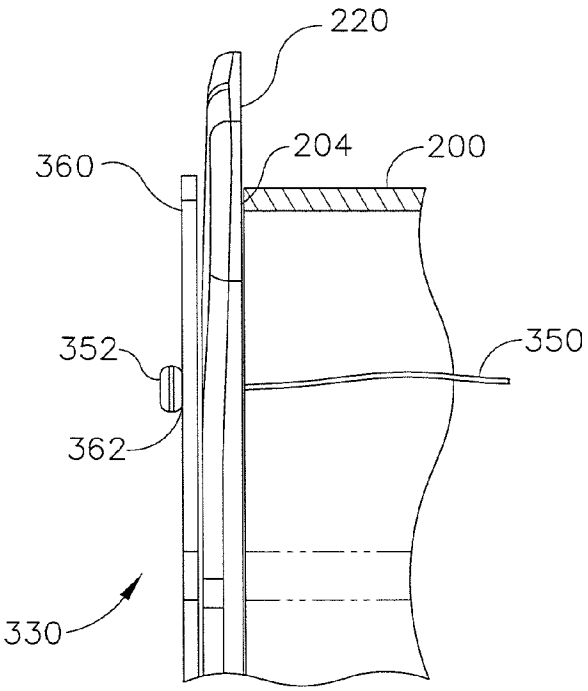
FIG. 8 depicts a partial top cross-sectional view of the free end of the fan blade of FIG. 2.

One merely illustrative example of such a cable-based fan blade retention system is shown in FIGS. 2-9. In this example, each fan blade (200) has at least one channel (210) through which a pair of cables (350) extend Inner anchor assembly (300) further comprises an array of inner anchor members (310) angularly spaced about the periphery of plate (302) as shown in FIG. 5. By way of example only, for a 10-bladed HVLS (High Volume Low Speed) fan, such as the example shown in FIGS. 4-5, ten inner anchor members (310) are equally spaced about the periphery of plate (302). In some other versions, inner anchor members (310) are secured directly to hub (550), such that plate (302) is simply omitted. In the present example, each inner anchor member (310) is located approximately 36 degrees from the next inner anchor member (310). As shown in FIG. 6, inner anchor member (310) comprises a first base portion (312), a rear anchor portion (314) extending from first base portion (312), a second base portion (316), and a fore anchor portion (318) extending from second base portion (316). Rear anchor portion (314) and fore anchor portion (318) further each define a hole (320) to which a cable may be coupled, such as cable (350) of FIGS. 7-8. In the present example, second base portion (316) is also angled from first base portion (312) at an offset angle such that fore anchor portion (318) is substantially aligned just aft of the leading edge of a first fan blade (200) and rear anchor portion (314) is substantially aligned just fore of the trailing edge of a second fan blade (200). In the example of a 10-bladed HVLS fan, the angle between first base portion (312) and second base portion (316) is also approximately 36 degrees. Other suitable configurations for inner anchor members (310) for fans having a various numbers of fan blades, including the angle between the first base portion (312) and the second base portion (316), will be apparent to one of ordinary skill in the art in light of the teachings herein.

FIGS. 7-8 show an exemplary fan blade (200) comprising a winglet (220) coupled to second end (204) of fan blade (200), as described above. In the present example, winglet (220) further comprises a pair of outer anchor holes that are substantially aligned with corresponding holes (320) on inner anchor members (310) on inner anchor assembly (300) for that respective fan blade (200). Outer anchors (330) of the present example each comprise an outer anchor plate (360) located outboard of respective winglets (220). Each anchor plate (360) has a shape that is similar to the cross-sectional profile of fan blades (200) in this example, though it should be understood that any other suitable shape may be used. Each anchor plate (360) defines a pair of plate holes (362) that are substantially aligned with the outer anchors holes in winglet (220) and holes (320) on inner anchor members (310) on inner anchor assembly (300) for that respective fan blade (200). Alternatively, outer anchor plate (360) may comprise threaded posts that are substantially aligned with corresponding outer anchors holes in winglet (220); and when outer anchor plate (360) is aligned, the threaded posts may be inserted through the outer anchor holes of winglet (220). While some exemplary configurations for outer anchor plate (360) have been described, still other suitable configurations for anchor plates (360) may be implemented as will be apparent to one of ordinary skill in the art in light of the teachings herein.

Figure 9:
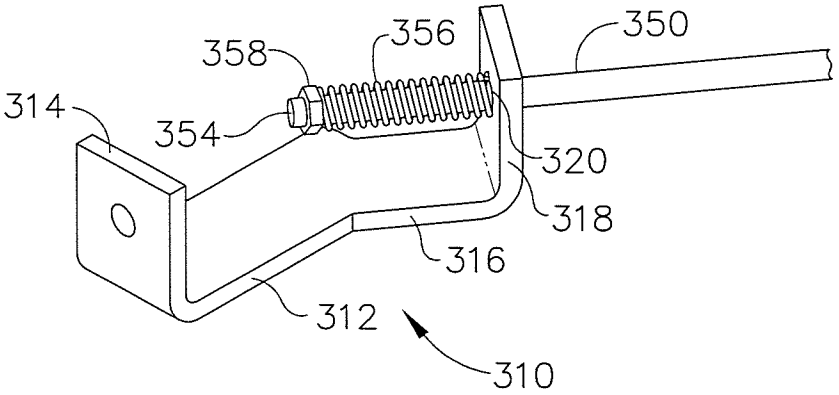
FIG. 9 depicts a perspective view of the inner anchor member of FIG. 6, showing a cable attached thereto.

As shown in FIGS. 7-9, cable (350) is passed from outer anchor plate (360), through the outer anchor hole of winglet (220), then through a channel (210) of fan blade (200), and finally to inner anchor member (310) on inner anchor assembly (300) on hub assembly (100). In the present example, the outer end of each cable (350) is fitted with a swaged tip (352), as best seen in FIG. 8, which secures cable (350) relative to the exterior of outer anchor plate (360). The inner end of each cable (350) is fitted with a threaded shaft (354) to permit attachment and adjustment of the tension of cable (350). Threaded shaft (354) is passed through a hole (320) in the corresponding rear anchor portion (314) or fore anchor portion (318) of inner anchor member (310). Threaded shaft (354) is then passed through a coil compression spring (356) and finally a threaded nut (358). By means of the combination of nut (358) and spring (356), and the selection of a spring (356) of appropriate length and spring rate, it is possible to bring each cable (350) to a precise specified tension, such that cable (350) is adequately taut to perform the function of retaining each fan blade (200) in the event of a structural failure elsewhere in fan (10), without being so tight as to impose an undesirable compressive load on fan blade (200) or other components or to impose an undesirable excessive tensile load on cable (350) itself. In one merely exemplary alternative, coil compression spring (356) and nut (358) may be replaced with a turnbuckle or other component suitable for selective tightening as will be apparent to one of ordinary skill in the art in view of the teachings herein.

Figure 10:
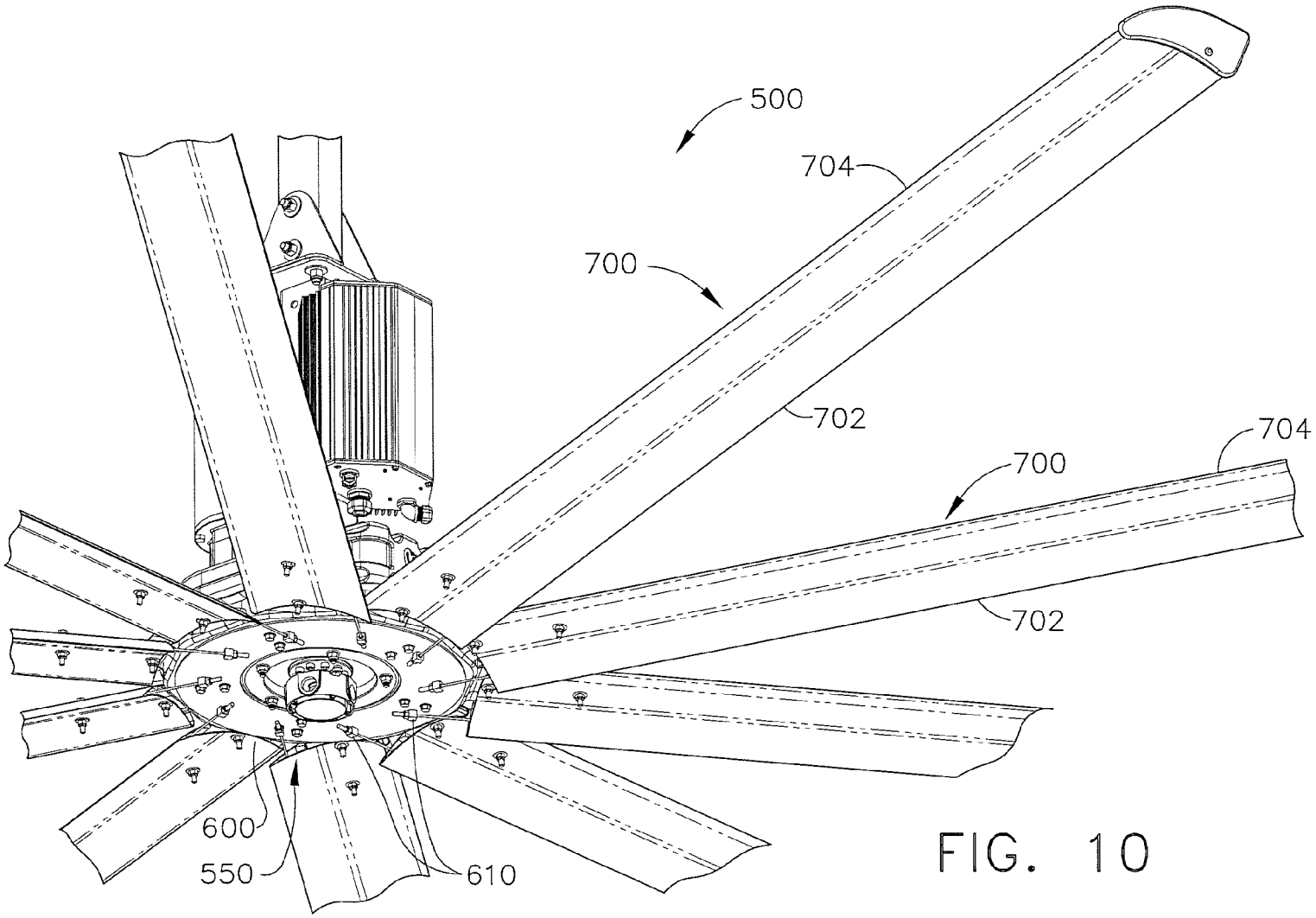
FIG. 10 depicts a partial bottom perspective view of an exemplary alternative fan.
Figure 11:
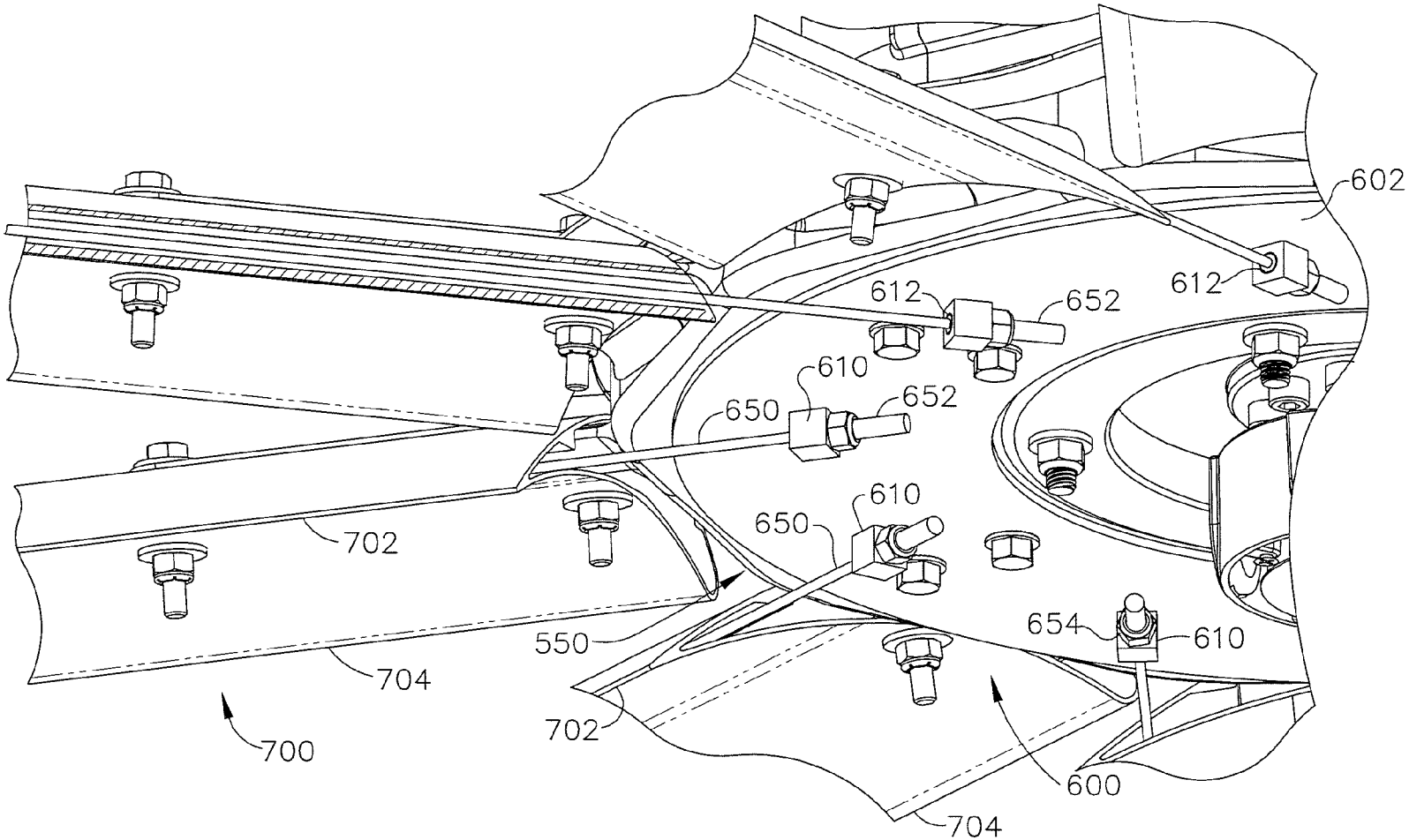
FIG. 11 depicts another partial bottom perspective view of the fan of FIG. 10, showing a hub assembly having an alternative inner anchor assembly.

Another merely illustrative example of a cable-based fan blade retention system is shown in FIGS. 10-13. As shown in FIG. 10, fan (500) of this example comprises a motor assembly (510), a support (520), a hub assembly (550), and a plurality of fan blades (700). Fan (500) is also in the context of a 10-bladed HVLS fan. In particular, as shown in FIGS. 10-11, hub assembly (550) comprises an inner anchor assembly (600) that includes ten inner anchor members (610). Each inner anchor member (610) on the inner anchor assembly (600) is aligned just forward of a trailing edge (702) of each fan blade (700). Alternatively, in other examples where just one inner anchor member (610) per fan blade (700) is used, the inner anchor members (610) may be located at any other suitable positions relative to the fan blades (700) (e.g., just aft of a leading edge (704) of each fan blade (700), etc.). As shown in FIG. 11, inner anchor assembly (600) comprises a disc-shaped plate (602) secured to hub assembly (550) (e.g., via bolts) and inner anchor members (610) that are welded to disc-shaped plate (602). It should be understood that disc-shaped plate (602) and inner anchor members (610) may be attached by any other suitable method as will be apparent to one of ordinary skill in the art in view of the teachings herein.

The cable-based fan blade retention system of the present example further comprises a plurality of cables (650). The inner end of each cable (650) is fitted with a threaded shaft (652) to permit attachment and adjustment of the tension of cable (650). Threaded shaft (652) is passed through a hole (612) in inner anchor member (610), then through a coil compression spring (such as coil compression spring (356) shown in FIG. 9) and finally a threaded nut (654). By means of the combination of nut (654) and the spring, and the selection of a spring of appropriate length and spring rate (or a turnbuckle or other component), it is possible to bring each cable (650) to a precise specified tension such that each cable (650) is adequately taut to perform the function of retaining each fan blade (700) in the event of a structural failure elsewhere in the fan (500). This may be accomplished without being so tight as to impose an undesirable compressive load on fan blades (700) or other components or to impose an undesirable excessive tensile load on cables (650) themselves. In some alternative versions, a cupped washer is used instead of a coil compression spring. For instance, a cupped washer may indicate that a proper tension has been reached when the cupped washer has been compressed flat between a nut and the inner anchor.

Figure 12:
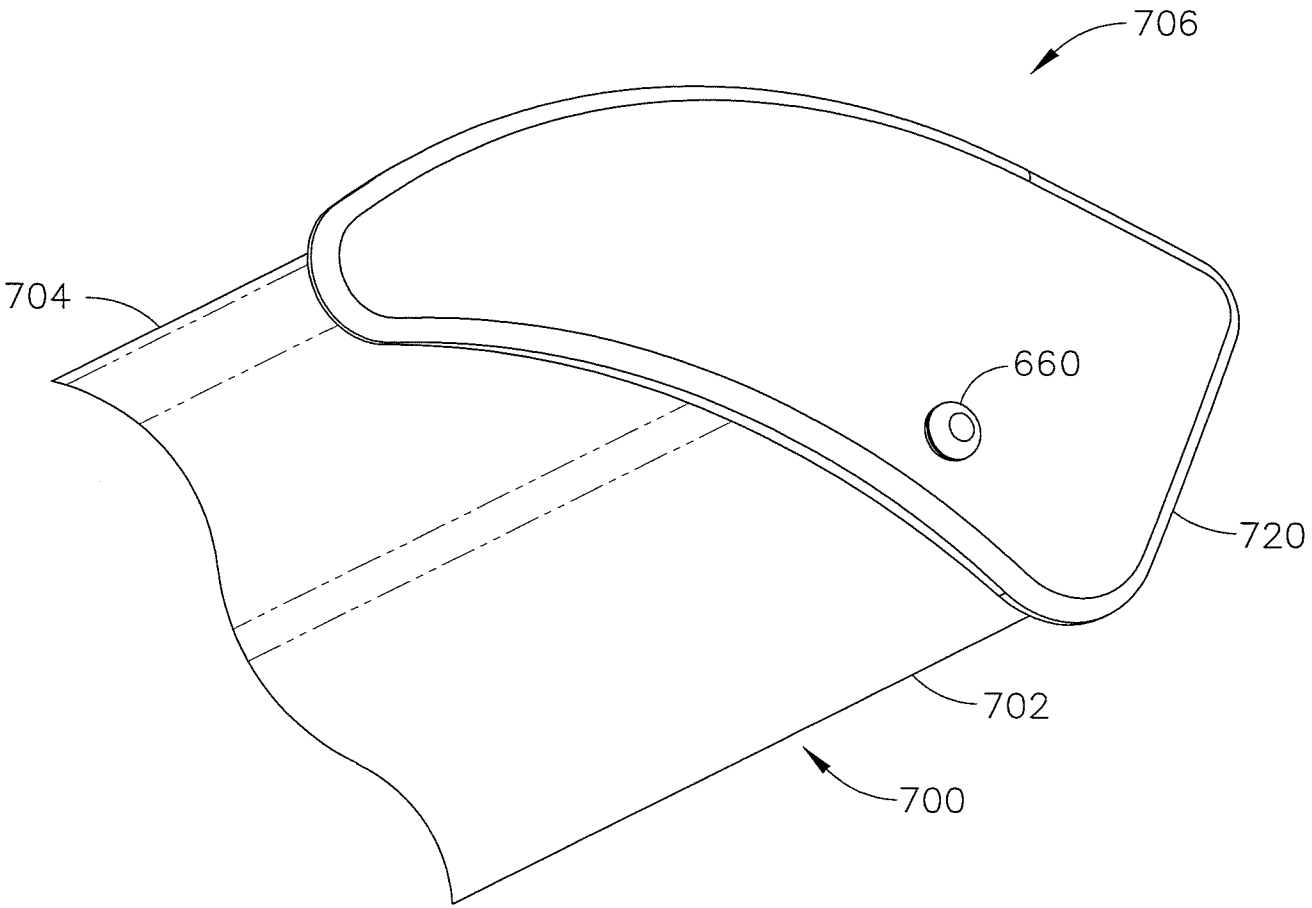
FIG. 12 depicts a partial perspective view of a free end of a fan blade of the fan of FIG. 10.
Figure 13:
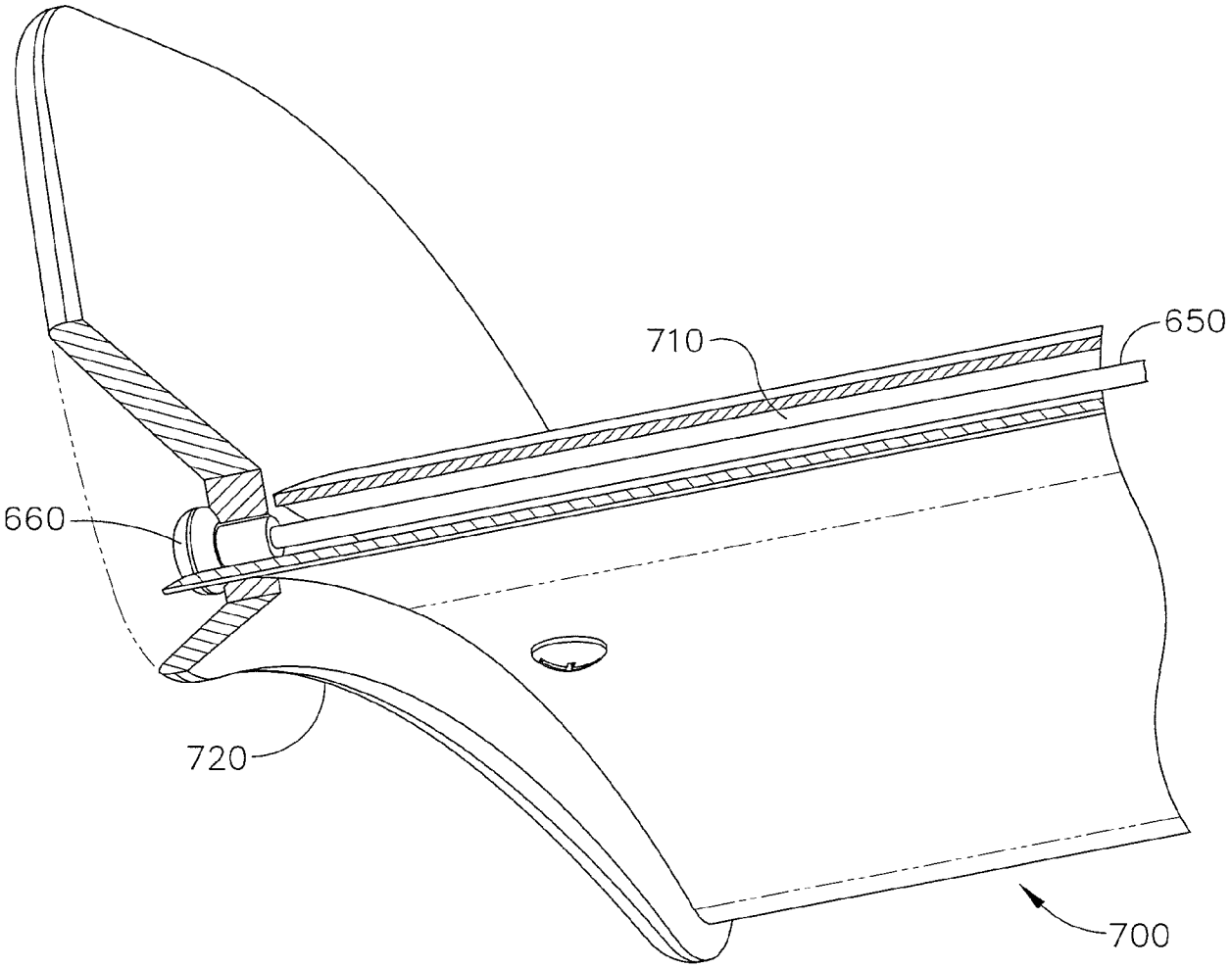
FIG. 13 depicts a partial cut-away view of the free end of the fan blade of the FIG. 12, showing a cable therein.

Similar to the example shown in FIGS. 2-9, cable (650) is secured at a first end to each inner anchor member (610) and at a second end to a winglet (720) of the corresponding fan blade (700), as shown in FIG. 12. Unlike the example shown in FIGS. 2-9, there is just one cable (650) per fan blade (700) in the example shown in FIGS. 10-13, such that just one cable (650) is secured to each winglet (720). Each cable (650) is passed from an outboard end (706) of each corresponding fan blade (700), through winglet (720), then through a channel (710) (as seen in FIG. 13) formed in fan blade (700), and finally to a corresponding inner anchor member (610) on inner anchor assembly (600). The second end of cable (650) has a swaged fitting (660) that is secured directly to winglet (720). This may be accomplished without using a separate outer anchor plate (such as outer anchor plate (360) shown in FIG. 7-8) positioned outboard to winglet (720), though it should be understood that an outer anchor plate may be used in present the example. Each cable (650) in the present example is secured to winglet (720) of each corresponding fan blade (700) at an attachment point such that cables (650) are positioned at a point below the plane of the bottom surface of the hub assembly (550). In other words, cables (650) positioned such that each cable (650) extends along a path that is below a plane defined by hub assembly (550). With inner anchor members (610) also extending below the plane defined by hub assembly (550), the resulting path of each cable (650) from inner anchor member (610) to swaged tip (660) at winglet (720) is positioned below the plane defined by hub assembly (550).

In the example shown in FIGS. 10-13, each cable (650) includes an exterior cushioning material (not shown) positioned along at least part of the length of each cable (650). Such a cushioning material is configured to prevent or at least reduce noise, which might otherwise occur in the event that cable (650) rattles against or otherwise strikes the interior of fan blade (700). Such a cushioning material may comprise a variety of types of materials or combinations of materials, including but not limited to flexible polymer, fabric, foam rubber, etc. Such cushioning material may extend along the entire length of each cable (650) that is positioned within each fan blade (700); or along any other suitable length. It should be understood that the cushioning material may also be provided about cables (350) for the example shown in FIGS. 2-9.

While the foregoing examples include cables (350, 650) being secured outboard of a winglet (220, 720), it should be understood that cables (350, 650) may instead be secured to a blade cap (e.g., when a winglet is omitted), to the end of each fan blade (200, 700) itself, and/or to some other structure. Other suitable ways in which the blade retention systems described herein may be made and used will be apparent to those of ordinary skill in the art in view of the teachings herein.

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometrics, materials, dimensions, ratios, steps, and the like discussed above are illustrative and are not required. Accordingly, the scope of the present invention should be considered in terms of claims that may be presented, and is understood not to be limited to the details of structure and operation shown and described in the specification and drawings.

We claim:

1. A fan comprising: (a) a motor assembly; (b) a rotatable hub assembly having an inner anchor assembly, wherein the rotatable hub assembly is rotatably coupled to the motor assembly, wherein the inner anchor assembly comprises a plate and a plurality of inner anchor members angularly spaced about the plate, and wherein each inner anchor member of the plurality of inner anchor members comprises a rear anchor portion and a fore anchor portion; (c) a plurality of fan blades, each fan blade comprising: i. a first end securably coupled to the rotatable hub assembly, ii. a second end, iii. a leading edge, iv. a trailing edge, and v. a channel extending from the first end to the second end; and (d) a plurality of cables, each cable having an inner end and an outer end; wherein each cable extends through the channel of a corresponding fan blade of the plurality of fan blades, wherein each cable is coupled at the outer end to the second end of the corresponding fan blade, and wherein each cable is coupled at the inner end to a respective inner anchor member of the plurality of inner anchor members.

2. The fan of claim 1, wherein the inner end of each cable of the plurality of cables comprises a threaded shaft, a spring, and a nut.

3. The fan of claim 1, wherein the plate is a disc-shaped plate and the plurality of inner anchor members are positioned angularly spaced the disc-shaped plate.

4. The fan of claim 1, further comprising a plurality of outer anchor members, wherein each outer anchor member is coupled to a fan blade of the plurality of fan blades at the second end of each fan blade.

5. The fan of claim 4, wherein each outer anchor member comprises an outer anchor plate, wherein each cable of the plurality of cables is coupled at the outer end to the corresponding outer anchor plate.

6. The fan of claim 5, wherein each outer anchor plate defines an outer anchor hole, wherein the outer end of each cable of the plurality of cables comprises a swaged tip sized and configured to prevent passage of the swaged tip through the outer anchor hole.

7. The fan of claim 1, further comprising a plurality of winglets, wherein each winglet is coupled to a fan blade of the plurality of fan blades at the second end of each fan blade.

8. The fan of claim 1, wherein each cable of the plurality of cables has an exterior surface and wherein each cable comprises a cushioning material disposed about a portion of the exterior of each cable.

9. The fan of claim 8, wherein each fan blade has a length, wherein the cushioning material is disposed about the portion of the exterior of each cable that is substantially coextensive to the length of each fan blade.

10. The fan of claim 1, wherein each inner anchor member has an offset angle, wherein the rear anchor portion and the fore anchor portion of each inner anchor member are angularly offset by the offset angle.

11. The fan of claim 10, wherein the rear anchor portion is substantially aligned with a trailing edge of a first fan blade of the plurality of fan blades and wherein the fore anchor portion is substantially aligned with a leading edge of a second fan blade of the plurality of fan blades.

12. The fan of claim 1, wherein the rear anchor portion comprises a first hole and the fore anchor portion comprises a second hole, wherein the first hole has a first longitudinal axis that is parallel to the trailing edge of a corresponding fan blade, and wherein the second hole has a second longitudinal axis that is parallel to the leading edge of a corresponding fan blade.

13. The fan of claim 1, wherein a first cable of the plurality of cables is coupled at the inner end to the rear anchor portion of a first inner anchor member and a second cable of the plurality of cables is coupled at the inner end to the fore anchor portion of the first inner anchor member.

* * * * *